US009302531B2

(12) United States Patent
Siegel

(10) Patent No.: US 9,302,531 B2
(45) Date of Patent: Apr. 5, 2016

(54) METHOD AND APPARATUS FOR PRODUCING A CUSTOM SIZED CANVAS STRETCHER FRAME

(71) Applicant: Marvin Siegel, Port Washington, NY (US)

(72) Inventor: Marvin Siegel, Port Washington, NY (US)

( * ) Notice: Subject to any disclaimer, the term of this patent is extended or adjusted under 35 U.S.C. 154(b) by 0 days.

(21) Appl. No.: 14/121,032

(22) Filed: Jul. 22, 2014

(65) Prior Publication Data

US 2016/0023506 A1 Jan. 28, 2016

(51) Int. Cl.
*B44D 3/18* (2006.01)

(52) U.S. Cl.
CPC ..... *B44D 3/185* (2013.01)

(58) Field of Classification Search
USPC ..... 160/374.1, 377, 379; 38/102.3, 102.5, 38/102.6
IPC ..... B44D 3/185
See application file for complete search history.

(56) References Cited

U.S. PATENT DOCUMENTS 1,916,022 A * 6/1933 Shull ..... B44D 3/185 160/374.1
3,012,362 A * 12/1961 Blinderman ..... A47C 17/66 160/374.1
3,651,854 A 3/1972 Terna
3,830,278 A * 8/1974 Packer ..... B44D 3/185 160/378
3,882,616 A * 5/1975 Starzyk ..... D05C 1/02 160/374.1
4,002,195 A * 1/1977 Nagase ..... E06B 9/52 160/379
4,144,660 A * 3/1979 Lamb ..... B44D 3/185 160/378
4,519,151 A * 5/1985 Johnson ..... B44D 3/185 160/374.1
5,839,214 A 11/1998 Peterson
6,253,471 B1 * 7/2001 Strauh ..... B44D 3/185 160/381
2010/0206497 A1 8/2010 Ocampo

* cited by examiner

*Primary Examiner* — David Purol
(74) *Attorney, Agent, or Firm* — Richard L. Strauss, Esq.

(57) ABSTRACT

A canvas stretcher frame and method for fabricating same is provided comprised of four perimeter members and four corner members. Each of the perimeter members demonstrates continuous and uniform corner tine receiving channels, mounting material receiving channels and a cross bar mounting channel running the entire length of the perimeter member. The corner members are formed of two corner sections and can be opened, via a key to increase frame perimeter. Due to the continuous and uniform shape and configuration of the perimeter members and the affixation means formed therein, the perimeter members may be cut to form a frame of any desired perimeter dimension without need for further mortizing or machining of the cut member prior to assembly.

12 Claims, 13 Drawing Sheets

METHOD AND APPARATUS FOR PRODUCING A CUSTOM SIZED CANVAS STRETCHER FRAME

TECHNICAL FIELD

The present invention is related to the field of canvas stretcher bars, canvas stretching frames and like device utilized to mount and properly tension canvas sheet materials.

BACKGROUND OF THE INVENTION

A canvas stretcher, also known simply as a "stretcher" is a frame which can be constructed in various manners and of various materials and which is utilized for mounting and properly tensioning canvas sheet material (such as, for example, paintings). The variations in stretcher design most commonly involves corner construction. Manufacturers of stretcher frames have traditionally assembled such from custom prepared corner and straight frame elements. Such assembly has required the production and use of both corner and straight frame (also known as "perimeter") members. Such production has required, in many instances, the preparation of mortised joints utilized for joining corner members to straight members, as well as similar joints utilized to form corners from, most often, two separate parts. In certain instances, pre-formed corner members have been utilized by such manufacturers so as to eliminate the need for preparing a mortised joint on the ends of such corners at the point and place of frame assembly, while still requiring such joinery to be performed upon perimeter members. Corner members utilized in such stretcher frames may be adjustable or non-adjustable.

An example of an adjustable corner is provided in what is commonly referred to as a "French" stretcher. Such stretcher frames include corners formed from two interlocking, but separable parts each having a 90 degree and 45 degree end. More specifically, such two piece corners include a mortised channel and assembly tine which provides a means for joining the two pieces which form each corner. Specifically, each of the two corner sections is attached to one another along a 45 degree end and, once affixed via the aforementioned mortised joint, from a 90 corner for the stretcher frame. Each end of the assembled corner is attached to a straight frame member at the 90 degree end of the corner sections so that when four corners are affixed to four straight frame member, a rectangular or square frame is formed. The straight members are affixed to the corner by any suitable means such as, for example, metal fasteners, glue, slots and tines or any other suitable means for forming a permanent joint. Mortised joints are preferred due to their strength and stability. Once assembled, the joint formed between each straight member and each corner is, in regard to a French stretcher, a fixed joint. However, the corners are assembled with an adjustable joint and so provide a means of adjusting the distance between each of the two sections making up each corner.

The mortised slot and tine assembly utilized to assemble a French stretcher corner includes an open, converging space adjacent to the slot which is commonly referred to as a keyway. An adjustment key, urged into such keyway, acts to open up a space between the two sections forming the corner. When such an adjustable corner is utilized in a quadrilateral (commonly square or rectangular) frame, insertion of a key into the keyway increases the space, not only between the two sections of the adjusted corner, but also increases the space between the two straight (perimeter) members stretcher affixed to either end of the corner. As discussed in more detail, below, the increase distance between perimeter members caused by the opening of one or more corners increases the perimeter dimension of the frame.

A canvas painting, for example, mounted upon a French stretcher frame, may be so mounted via, staples, screws or tacks to the back face of the perimeter and corner members forming the frame. Such canvas paintings are initially mounted at a preferred tension so as to properly display a relatively flat canvas without strain. However, over time, the canvas tends to sag as the dimensions of the material change, due, in large part, to changes in moisture content as well as changes in the canvas material structure itself. The aforementioned adjustable corners of a French stretcher enables simple re-tensioning of such a sagging canvas painting when required by simply adjusting, via key insertion, the perimeter dimension of the frame to which the canvas is affixed.

Besides the above-described adjustable corners, canvas stretchers may also utilize corners that are not, in fact, separable or otherwise adjustable. Such stretchers may achieve re-tensioning of a canvas by simple re-mounting the material to the frame in a more taught manner. On the other hand, other canvas stretchers provide frame adjustment without altering corner spacing. Such frames may utilize a corner which is assembled via a fixed (non-separable) joint, and provide adjustment by creating a space between the ends of the corner abutting perimeter members.

For example, the stretcher disclosed in U.S. Pat. No. 8,307,880 (THE "880 patent") stretcher, provides adjustment of frame size without including an adjustable corner. The stretcher disclosed in the '880 patent teaches the use of a two piece corner that is permanently assembled into a non-adjustable fixed corner piece. However, the '880 stretcher provides frame adjustment by affixing an adjustable screw to a fixed slot formed at a discrete and single location within the inside edge of perimeter sections adjacent to the each end of each such straight frame element. The '880 stretcher affixes the disclosed fixed corner to perimeter members by means of dowel pins and inserts. However, the joint formed between each straight member and corner is not permanently fixed. The screw type device of the '880 patent provides a means of adjusting the distance between each perimeter member (straight member) and the corner member to which it is attached. When the adjustment screw is rotated, the end thereof is advanced towards and against a force block extending from the corner. Contacting and biasing the adjustment screw against the force block partially separates the perimeter member to which the adjustment screw is attached from the corner. This separation, in turn, increases the perimeter dimension of the stretcher so as to apply tension to a canvas sheet affixed to the frame.

As mentioned above, pre-formed stretcher corners are well known to the industry and may be commonly utilized by commercial manufacturers. Such component parts enable ease of handling and shipment of stretcher materials prior to reaching the point of final assembly into a frame. Such pre-formed corners may be provided in either an adjustable or fixed configuration. Stretcher frames must be manufactured in varying sizes and shapes—such as rectangular or square—in order to be applicable to the various dimensions of the canvas they are designed to mount and stretch. In order to attain a perimeter dimension and shape (most often, rectangular or square) required for any given canvas, the perimeter members comprising the frame may be formed or cut to an appropriate length. Utilization of prepared corners, including adjustable French style corners, is of great assistance in the preparation of such frames since such corners may be provided with pre-formed mortised ends for quick assembly to perimeter members. However, regardless of the availability of such pre-formed corners, perimeter members whether pre-formed or not, often require cutting to a specific length and the point and location of frame assembly in order to provide a frame of a desired perimeter dimension. The cutting of a pre-formed perimeter member will, of course, eliminate any mortise joint preparation located at the end of the perimeter member being cut. Although it might be possible to assemble a stretcher frame from both pre-formed and mortised corner and pre-mortised perimeter members, such would obviate the production of custom sized frames have a perimeter dimension other than the one provided by the stock perimeter members—without having to reproduce the joinery cut off the end of the perimeter member after cutting same to provide the desired frame dimensions.

It would be highly beneficial if pre-formed stretcher components could be disclosed, as well as a method for forming a custom sized stretcher frame, that would allow for the production of frames of any desired perimeter dimension, without the need for performing additional joinery upon one or more ends of the perimeter members requiring cutting in order to produce such custom sized frames.

The most time consuming and labor intensive portion of custom stretcher production is the preparation of the mortised joints which are prepared at each end of the perimeter member. However, such mortised joints, as opposed to a joint which is simply nailed, screwed or glued, provides the stable joint required between the perimeter and corner members of a custom stretcher. There is also much time devoted to placement and affixation of cross member supports along the inside edges of the perimeter members to which they are affixed.

It would be highly advantageous if pre-formed corner and perimeter members were disclosed which enabled one to quickly and easily assemble a canvas stretcher of a desired perimeter dimension—having adjustable corner members—, without having to perform, joinery upon the end of each perimeter member requiring custom cutting prior to assembly. It would be further advantageous if such a custom canvas stretcher kit could be provided which enabled quick and simple affixation of cross bars to the frame without having to perform further joinery upon perimeter members or the cross bar(s) after custom cutting of same.

SUMMARY OF THE INVENTION

Now in accordance with the present invention, a canvas stretcher is disclosed enabling the efficient and rapid production of custom sized canvas stretcher frames—demonstrating a desired perimeter measurement—from pre-formed components. The disclosed canvas stretcher is comprised of four perimeter members and four corner members. The term "custom sized canvas stretcher", "custom sized stretcher frame" and "custom sized stretcher", as utilized throughout this specification and within the claims refers to a stretcher frame demonstrating a specific perimeter dimension suitable for mounting a canvas sheet material upon such a stretcher. The term "PERIMETER DIMENSION" and "PERIMETER" as utilized throughout this specifications and within the claims, are equivalent terms having the same meaning and refer to the measurement of the perimeter of the quadrilateral stretcher frame formed when four corner members and four perimeter members are joined to form the frame as measured along the outside edges of the perimeter and corner members.

The present invention also provides an improved method for providing a custom sized canvas stretcher from stock perimeter and corner members without the need for providing additional mortising or other joinery. The term "stock perimeter member" refers to perimeter members, formed, shaped and configured in accordance with the present invention, provided in a plurality of standard lengths, which may be cut to a desired length (to form a stretcher frame of a desired perimeter length), without need for additional miter, mortise or other preparation required for attaching same to a corner member via, for example, a mortise joint (tine and tine receiving joint). It is preferred that such stock perimeter members are formed in lengths ranging from about 18 inches in length to about 15 feet in length. However, it is further preferred that such stock perimeter members demonstrate a length of from about 40 inches to about 96 inches as such stock lengths may be custom cut to provide frames demonstrating perimeter lengths required for the majority of canvas sheets to be mounted thereupon. The term "stock corner members" refers to corner members, as described below, pre-formed, shaped and configured to enable rapid attachment of same to perimeter members in order to form a stretcher frame without need to further miter or perform any other corner preparation prior to such attachment.

As mentioned above, the canvas stretcher of the present invention utilizes four perimeter members. Each of the perimeter members includes at least one perimeter tine receiving channel running longitudinally along the entire length thereof. The at least one perimeter tine receiving channel is open at both ends of the perimeter member and defines a cross sectional size, shape and configuration which is continuous and uniform along the entire length of the perimeter member and which enables the below-described perimeter retaining tine extending from the corner member to matingly engage therewith. Each perimeter member also includes a mounting material retaining channel extending along the entire length of said perimeter member. The mounting material retaining channel demonstrates a continuous opening along the back surface of each perimeter member and is especially shaped and configured to receive and contain a length of mounting material therewithin. In the same manner as the perimeter tine receiving channel as well as the cross bar mounting block channel, discussed below, the cross sectional shape and configuration of the mounting material retaining channel is continuous and uniform along the entire length of the perimeter member. The mounting material is especially selected to be a material upon which sheet material—such as canvas—may be affixed with, for example, staples, tacks, brads or any other suitable fastener. Suitable mounting material includes, but is not limited to wood, cork, rubber and plastic material.

In addition to the above-mentioned design, features and configurations, each perimeter member also includes a cross bar mounting block channel. The cross sectional shape and configuration of the cross bar mounting block channel is uniform and continuous along the entire length of the perimeter member. It is located adjacent to and provides a uniform and continuous opening along the inner edge of the perimeter member. The cross bar mounting block channel runs longitudinally, within the perimeter member, from one end to the other. The term "from one end to the other" and the term "entire length" as utilized within this specification and the claims are equivalent terms and refer to the measured length of each perimeter member from one end thereof to the other.

Each of the four corner members is comprised of two corner sections. The corner sections include a 45 degree end and a 90 degree end. The 45 degree ends of the corner sections are mortised so as to include at least one corner section tine receiving slot and at least one corner section tine. The corner section tine and corner section tine receiving slot are formed, arranged and positioned so that the 45 degree ends of two corner sections can be securely joined, one to the other, so as to form a corner member. The corner member provides the 90 degree corners for the stretcher frame.

As mentioned above, the corner section tine receiving slot is especially shaped and configured to provide mating engagement with a corresponding corner section tine located on the 45 degree end of a complimentary corner section. However, each corner tine receiving slot also demonstrates and provides a keyway upon the joining of two such sections to form a corner member. The keyway is, in fact, a converging slot formed between a wall of the corner tine receiving slot and corner tine after two corner sections are joined to form a corner member. Upon the above-described joining of two corner sections to form a corner member, the keyway provides an opening, at its widest cross sectional dimension, at a point located along the inner edge of each corner section. Placement of a corner key into this opening, and thereafter urging the key further into the corner, along the converging walls, causes the two corner sections forming the corner member to move apart. The opening of the corner member necessarily increases the perimeter dimension of the stretcher frame.

As mentioned above, The term "PERIMETER DIMENSION" and "PERIMETER" as utilized throughout this specifications and within the claims, are equivalent terms having the same meaning and refer to the measurement of the perimeter of the quadrilateral stretcher frame formed when four corner members and four perimeter members are joined to form the frame as measured along the outside edges of the perimeter and corner members. Opening a space between to corner sections by inserting a corner keys into one or more corner members creates and/or increases the perimeter dimension. Such an increase in perimeter dimension is accomplished by creating a space, having length, between two corner sections forming the corner member. Opening this space, and thus increasing the perimeter of the frame, necessarily applies tension upon a canvas mounted upon the frame.

Each of the 90 degree ends of the corner sections includes at least one perimeter retaining tine extending therefrom. The perimeter retaining tine is especially shaped and configured to enable mating engagement with the perimeter tine receiving channel. This engagement enables the 90 degree end of the corner sections to be securely affixed to a perimeter member.

The aforementioned elements are advantageously joined, as described, to form a quadrilateral frame of a desired perimeter dimension. Generally, the quadrilateral frame is formed to demonstrate a square or rectangular configuration. The desired perimeter dimension and frame shape is selected in accordance with the dimensions of a canvas to be mounted upon the frame. The desired dimension of the frame is accomplished by cutting perimeter members to a length, which, when combined with the corner members, will yield a desired perimeter. Because the perimeter retaining tine receiving channel, formed within the perimeter member, is continuous along the entire length of the perimeter member, and, because adjustment to frame tension is provided by means of adjusting the distance between corner sections, the perimeter members may be cut to any desired length without effecting the corner tine receiving channel and without effecting the tensioning function of the stretcher.

Cutting of the perimeter members to a desired length (in order to produce a frame of a desired perimeter measurement), does not effect the function of the cross bar mounting channel. This channel, like the perimeter tine receiving channel, runs continuously along the entire length of the perimeter member, from one end to the other. Thus, cutting the perimeter member has no effect upon attachment of a cross bar mounting block at any point along the inside edge of the perimeter member.

As mentioned above, certain preferred embodiments of the present invention include a cross bar utilized to increase the rigidity, strength and adjustability of the disclosed stretcher frame. Such preferred embodiments include at least two cross bar mounting blocks and at least one cross bar. The cross bar mounting block is comprised a perimeter engagement section and an intermediate connector section.

The distal end of the perimeter engagement section is especially shaped and configured to mate with and mount slideably within the cross bar mounting block channel. When the cross bar mounting block is positioned within the mounting block channel, the continuous opening thereof enables the block to slide to any desired position, from one end of the perimeter member to the opposite end. The sliding of the block within the channel enables quick, convenient positioning of the cross member at virtually any position along the inside edge of the perimeter member as desired.

The proximal surface of the perimeter engagement section advantageously includes a tine engagement slot which is especially shaped and configured so as to enable mating engagement with a tine, extending from the distal end of the intermediate section, so as to effectively fasten the perimeter engagement section to the intermediate section. The perimeter engagement section may also advantageously include one or more set screw bores running from an opening located at the distal end of the engagement section, completely through the engagement section to an opening prepared at the proximal end of the engagement section. The one or more set screw bores are especially configured and prepared so as to enable a set screw to be threaded through said bore via rotation of the screw and thereafter, upon further rotation, to bias against an inner wall of the cross bar block channel so as to fix the position of the block therewithin.

The intermediate connector section of the cross bar mounting block includes a proximal end, a distal end, a front surface, a back surface, a top surface and a bottom surface. The distal end of the intermediate connector includes at least one intermediate section tine especially shaped and configured to matingly engage with the tine engagement slot formed within and presenting an opening located at the proximal end of the perimeter engagement section. Engagement of the intermediate section tine with the tine engagement slot within the perimeter engagement section joins the two sections to form the complete cross bar mounting block. Located adjacent to the intermediate section tine, a mounting block keyway is prepared within the intermediate section. The keyway, as described and illustrated in more detail, below, is configured and shaped so as to form a slot with an opening located on the top, bottom, and distal surface. Upon affixation of the intermediate connector section with the perimeter engagement section, the opening of the slot on the distal end of the intermediate connector section lies directly against and adjacent to the proximal surface of the perimeter engagement section. A converging wall configuration of the slot forms a keyway upon the joining of the aforementioned mounting block sections. This keyway is especially shaped and configured for the insertion of a cross bar mounting block key. Insertion of the key within the keyway forces the two sections of the mounting block—the perimeter engagement section and the intermediate connector section—to separate. The separation of these two sections, in turn, provides increase distance and tension—adjustability—between two perimeter members upon which cross bar mounts and a cross bar are mounted.

The proximal end of the intermediate connector section of the cross bar mounting block includes at least one cross bar engagement tine extending therefrom. In preferred embodiments of the present invention, the proximal portion of the intermediate connector forms the cross bar engagement time. The cross bar engagement tine is especially shaped and configured so as to enable the tine to mate and securely engage a tine engagement channel located within, and along the entire length of the cross bar, as described in greater detail, below.

The cross bar of the present invention includes at least one tine engagement channel, running the entire length thereof and which said channel is open at either end of the cross bar. The cross sectional shape, configuration and size of the tine cross bar tine receiving channel are especially formed to provide mating engagement with the cross bar engagement tine extending from the proximal end of the intermediate connector. The cross bar of the present invention thus demonstrates a continuous and uniform cross sectional shape and configuration. Therefore, after cutting of the cross bar to a desired length, as discussed below, the cross bar will still demonstrate the aforementioned tine engagement channel so as to obviate the need for preparing a miter, mortise or other joint at either end of the cross bar after such cutting. It is advantageous to provide such cross bars in standardized lengths so that they may be cut to fit stretcher frames of any desired perimeter dimension. The term "stock cross bar" as utilized within this description and throughout the claims refers to cross bars demonstrating the above-described continuous and uniform cross sectional shape and configuration provided in standardized lengths. It is preferred that such stock cross bars demonstrate a length of from about 18 inches to about 15 feet. However, it is still further preferred that such stock cross bars demonstrate a length of from about 40 to about 96 inches as such lengths may be cut to fit stretcher frames of the present invention demonstrating perimeter dimensions suitable for the majority of canvas sheet material to be mounted upon the present stretcher frame.

Two cross bar mounting blocks, as described above, may be used to mount a cross bar between two opposite perimeter members forming the stretcher of the present invention. The stretcher of the present invention enables the cutting of the perimeter members forming, along with four corner members, the stretcher, so as to attain a desired perimeter dimension. Upon cutting such perimeter members, and thereafter joining four such members via the above-described corner members to form a square or rectangular frame, two of the above-described cross bars mounting blocks may be mounted within mounting block receiving channels located adjacent to and open along the inner edge of opposing perimeter members. The mounting block receiving channel of the perimeter member is a continuous channel. Thus, regardless of how much perimeter bar is cut to attain a desired frame size, the cross bar can be quickly and easily positioned without having to prepare new mount.

Likewise, cutting the perimeter members to a achieve a desired perimeter size can likewise change the length of cross bar required to span the distance from one cross bar mount to an opposite mount. Since the tine engagement channel formed within the cross bar of the present invention is continuous, the cross bar can be cut in accordance with changes in perimeter dimension without need for mortising a new tine receiving channel within the bar.

For example, one may wish to cut perimeter members of the present invention to form a frame having a given perimeter dimension. After these members are cut, they are joined by use of corner members without need for preparing new perimeter tine receiving channels. Since these perimeter tine receiving channels are continuous along the entire length of the perimeter members, there is no need to mortise or otherwise prepare a new tine receiving channel after cutting the perimeter member. Thereafter, if, for example, it is desired to incorporate one cross bar running between a pair of opposite perimeter members within the stretcher frame, the perimeter engagement section of a cross bar mount is simply inserted into, and slid along the cross bar mounting block channel located alongside the inside edge of the perimeter member until it is located at, for example, the midpoint of the length of the perimeter member. Since the mounting block channel runs the entire length of the perimeter member, there is no need to prepare, mortise or otherwise form a new mounting joint for the cross bar mount. A like cross bar mounting block would then be mounted within the mounting block channel of the opposite perimeter member. A measurement of the distance between the proximal ends of the intermediate section of the mounting blocks may then be utilized to calculate the length of cross bar necessary to span the distance between the mounting blocks. This distance is calculated so as to provide that the cross bar will be of the proper length to enable full insertion of the cross bar engagement tine within the engagement channel of the cross bar. Since the tine engagement channel of the cross bar is continuous, along the entire length of the cross bar, the cross bar may be cut without having to mortise a new engagement slot therein. Thus, the stretcher kit of the present invention enables custom cutting of perimeter members and cross members to be accomplished quickly and easily without need for spending substantial time and effort in creating custom mortising within the custom cut members of the frame.

In certain preferred embodiments of the present invention, it may be desired to utilize more than one cross bar running between a single or both pairs of opposing perimeter members forming the frame. In instances wherein it may be desired to affix two or more cross bars to two opposing, sets of perimeter members the cross bars will necessarily intersect. In other words, in certain embodiments, the frame formed by the canvas stretcher may include cross bars extending between all four perimeter members forming the frame. In such instances, the stretcher of the present invention provides a cross bar intersection which enables the back and front surface of the cross bars to lie within the same horizontal plane with one another while also further stabilizing the cross bars—despite the fact that such intersecting cross bars would otherwise overlap on another.

The cross bar intersection of the present invention includes two cross bar insertion sections located adjacent to opposite ends of the intersection and a central bypass section located between the cross bar insertion sections. The cross bar insertion sections are especially shaped and configured so as to enable insertion of same within the tine engagement channel of a cross bar. Since the insertion sections are located at both ends of the cross bar intersection section, the intersection serves to join to lengths of cross bar extending from opposite perimeter members so as to form a structurally complete bar which can span the distance between two opposite perimeter members. The insertion sections are advantageously shaped and configured so as to align the tine engagement channels of two cross bars so that the front and back surfaces of such cross bars lie within the same horizontal plane and so that the upper and lower surfaces of such cross bars are also aligned, one with the other.

As mentioned above, when embodiments of the present invention utilize cross bars running between two pairs of opposing perimeter members so as to necessitate such cross bars running across one another, (generally, at a 90 degree angle) provision for the elimination of overlap of such cross bars is advantageous so as to maximize the stability provided by same achieved by maintaining such cross bars within the same horizontal plane and in order to present a flat surface against which to mount a canvas. In order to eliminate the aforementioned overlap, it is advantageous that the central bypass section is offset towards the horizontal plane defined by the back or front surface of the cross bars. In addition, it is highly advantageous that the cross bar bypass section demonstrate a thickness—measured as the distance between the inner and outer surfaces of the bypass section—which is less, and most advantageously approximately ½ the thickness of the insertion ends of the cross bar intersection.

By utilizing a bypass section having ½ the thickness of the insertion section and offset so as to lie in the same horizontal plane as either the front surface or back surface of the insertions sections of the cross bar intersection, the bypass sections of two such cross bar intersections can be jointed, at a 90 degree relationship, to from a 4-way intersection enabling cross bars originating from two pair of opposite perimeter members to intersect and lie within the same horizontal plane. Put simply, the offset, reduced thickness of the bypass section enables assembly of two cross bar intersections at a 90 degree relationship so as to place the front surfaces and back surfaces of all four engagement sections of the intersection to lie in the same horizontal plane. Thus, cross bars inserted therein will likewise be aligned so as to be horizontally aligned in regard to the same horizontal plane.

In practicing the method of the present invention, four perimeter members, as described above, are selected. Thereafter, it is determined, by measurement of a canvas to be mounted upon the stretcher, what the required perimeter dimension of the stretcher is utilizing the usual methods for such, well known to the art. Thereafter, the perimeter members are cut to the appropriate length and thereafter joined by four corner members of the present invention to form a stretcher demonstrating the required perimeter measurement appropriate for mounting a canvas of a specific dimension. Since the corner tine receiving channel formed within the perimeter members are continuous, running from one end thereof to the other, after cutting the perimeter members to the length required to provide a frame of the desired perimeter dimension. The stretcher frame may be assembled without having to further mortise or provide any additional joinery therein—even after cutting the perimeter members to the required lengths—. Similarly, because the cross bars of the present invention also demonstrate a continuous tine engagement channel, cutting same in order to properly fit same to a custom sized frame (as described immediately above), does not require any mortising or other preparation of the cross bar prior to attachment of same to the cross bar mounts also described above. In a similar fashion, cutting the perimeter members to any desired length does not interfere with the mounting of cross bars thereto. Because the mounting block channel is presents a continuous channel running the entire longitudinal length of each perimeter member, cutting of the perimeter member does not require any further preparation of the member in order to mount the cross bar at any desired point along the entire length thereof.

Figure 4A:
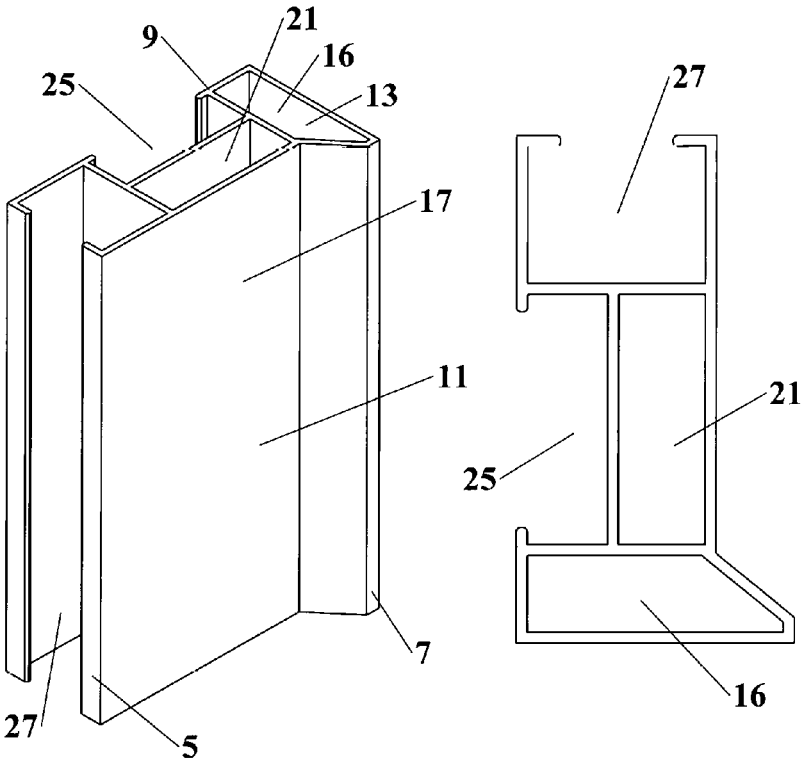

FIG. 4*a* illustrates a front isomeric and sectional view of a perimeter member of the present invention.

Figure 4B:
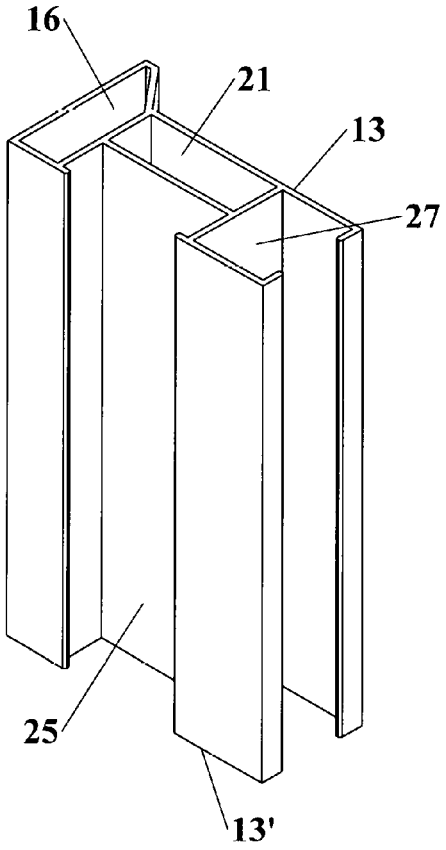

FIG. 4*b* illustrates a back isomeric view of the perimeter member of the present invention.

Figure 5A:
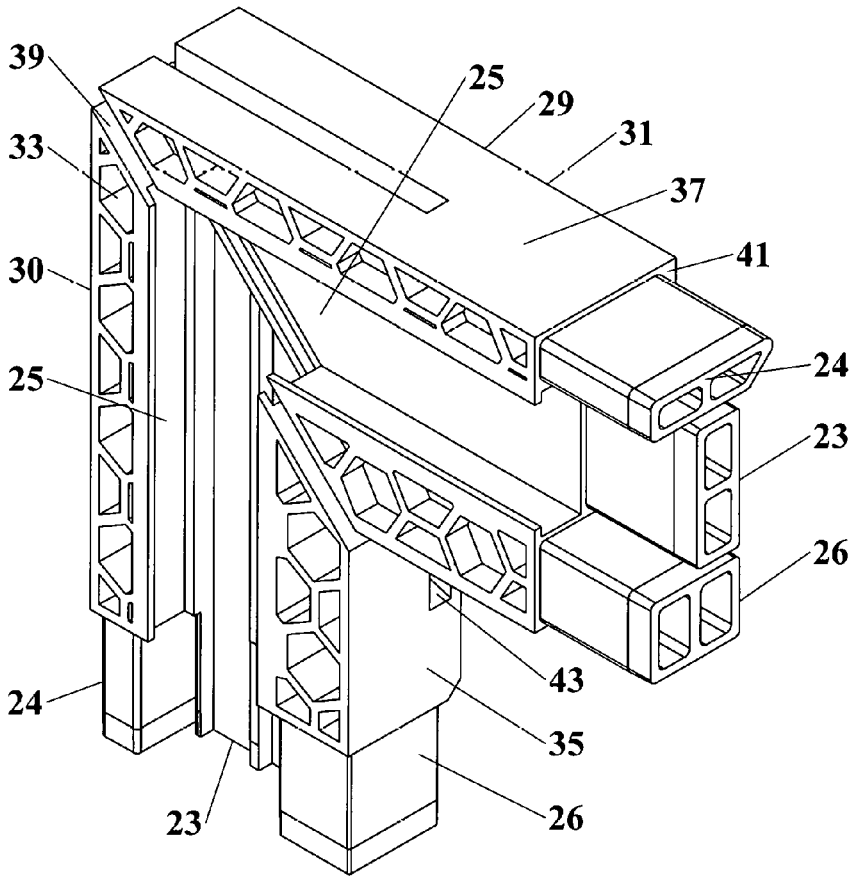

FIG. 5*a* illustrates a top isomeric view of a corner member of the present invention.

Figure 5B:
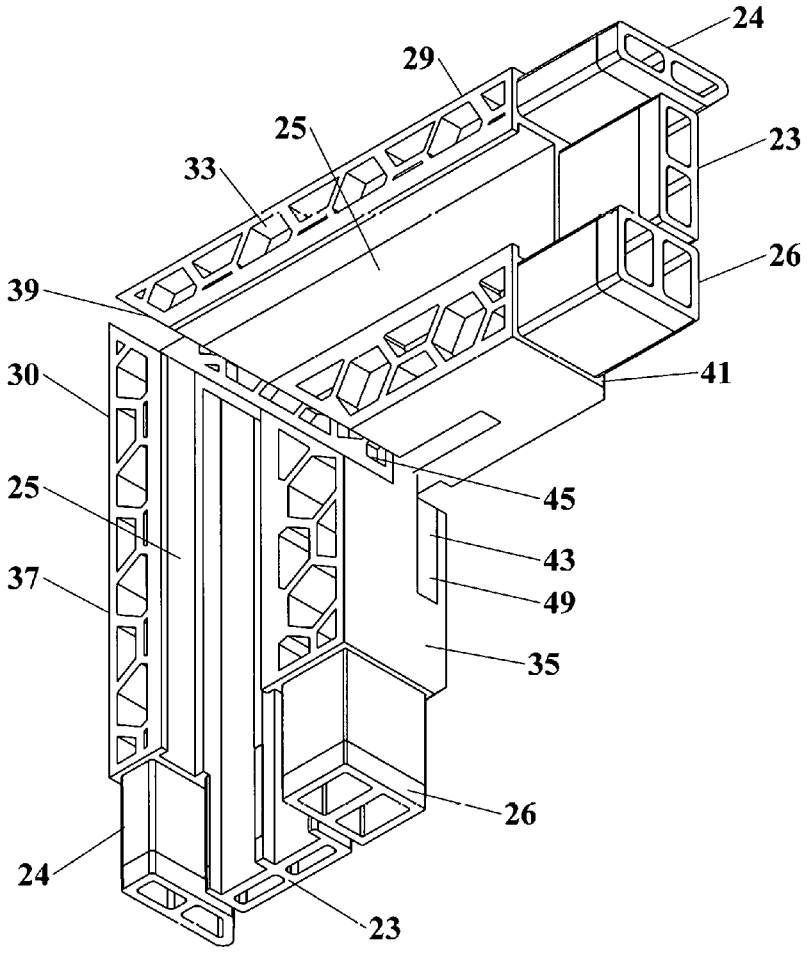

FIG. 5*b* illustrates a bottom isomeric view of a corner member of the present invention.

Figure 6:
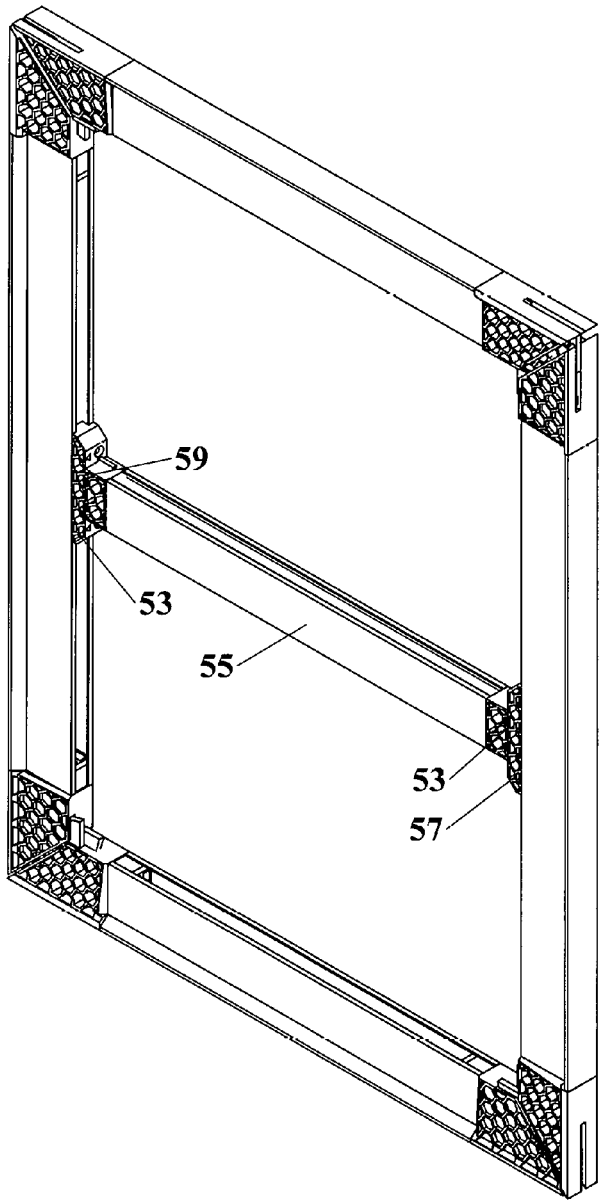

FIG. 6 is a front isomeric view of a preferred embodiment of the present invention incorporating one cross bar.

Figure 7:
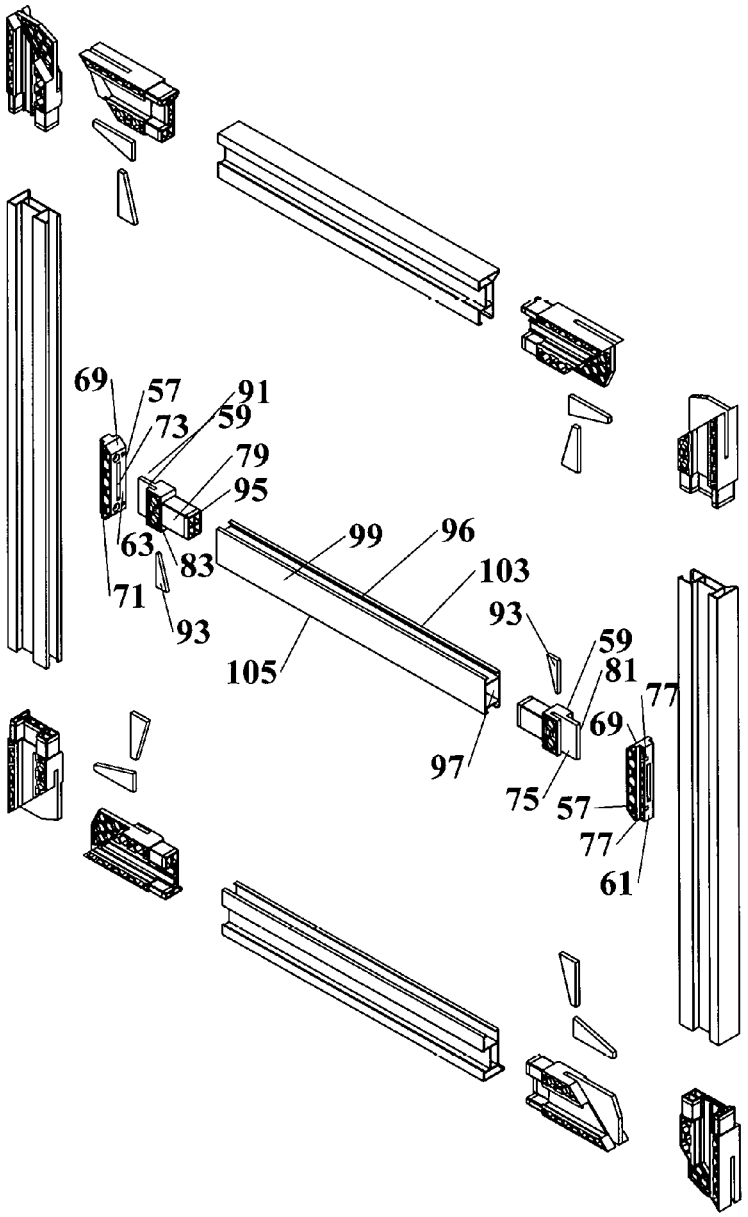

FIG. 7 is an exploded view of the preferred embodiment illustrated in FIG. 6.

Figure 8:
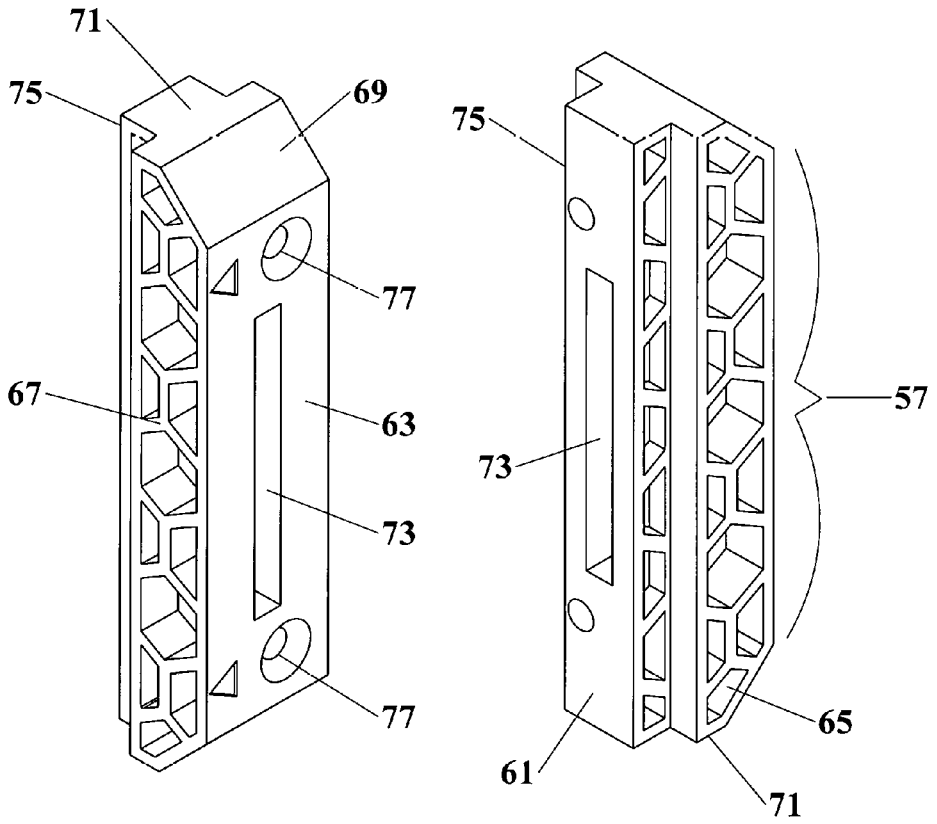

FIG. 8. is an isomeric view of the perimeter engagement section of the cross bar mounting block of the present invention.

Figure 9:
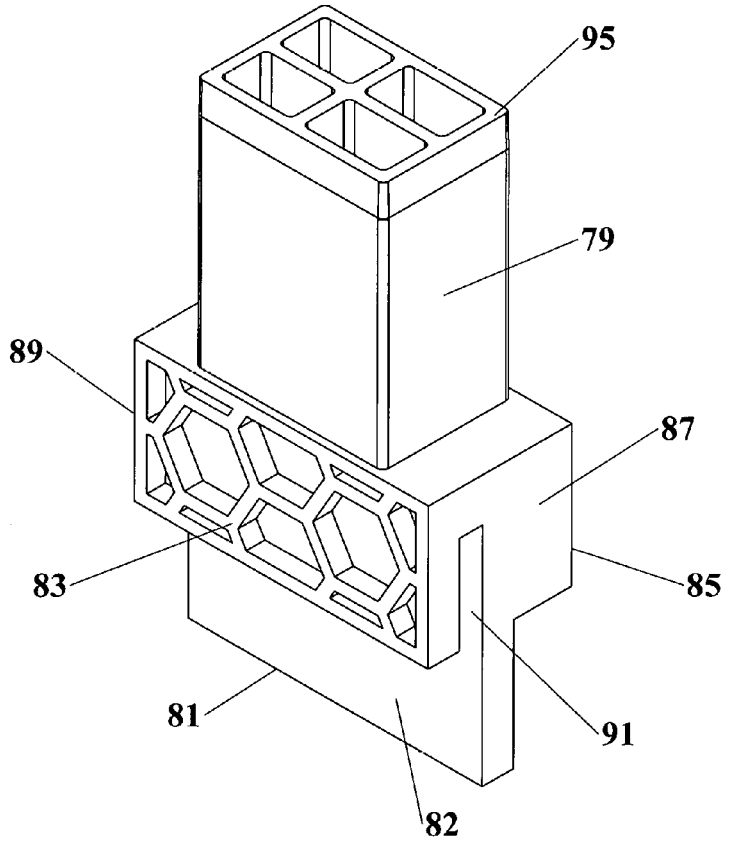

FIG. 9 is an isomeric view of the intermediate connector section of the cross bar of the present invention.

Figure 10:
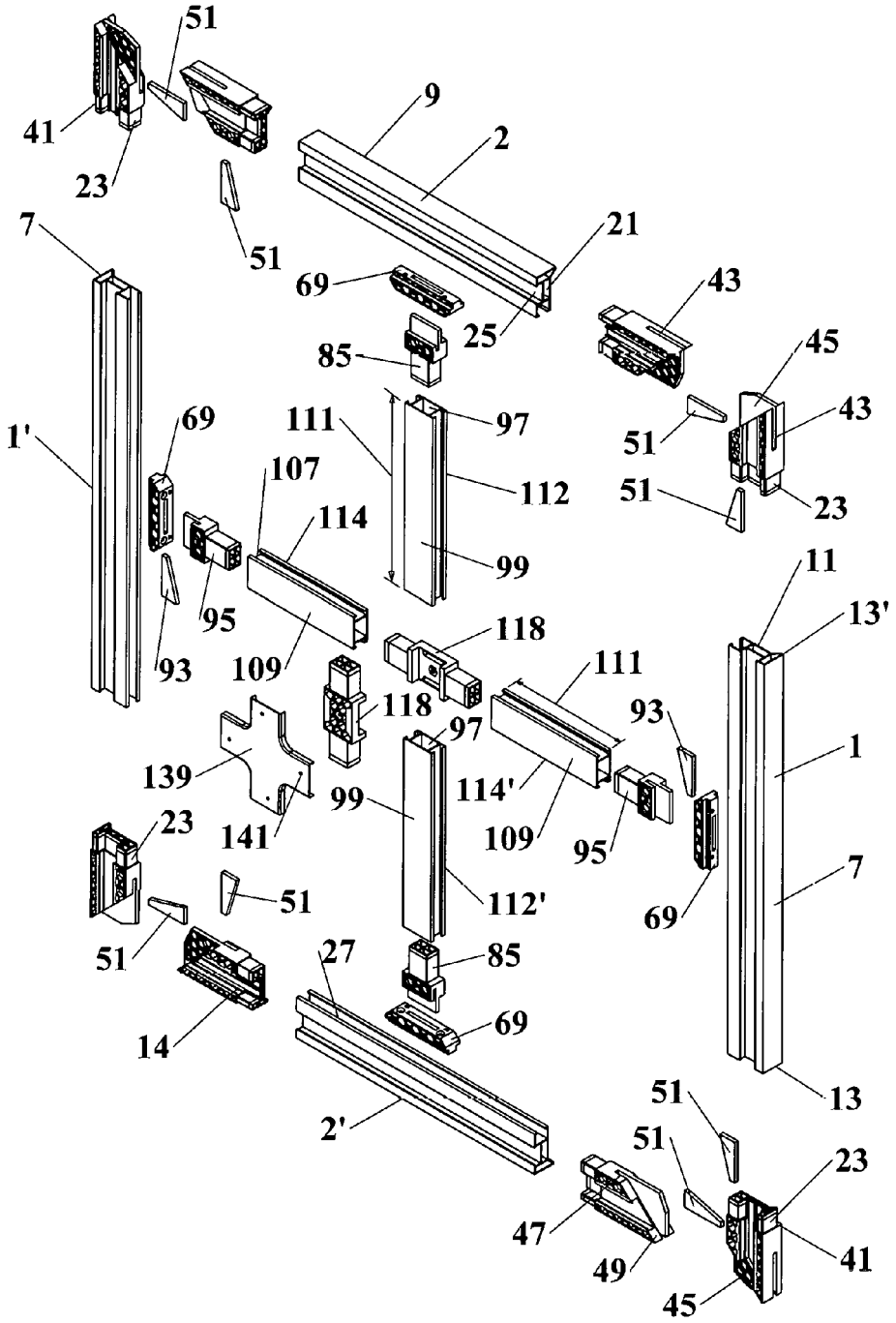
Figure 11:
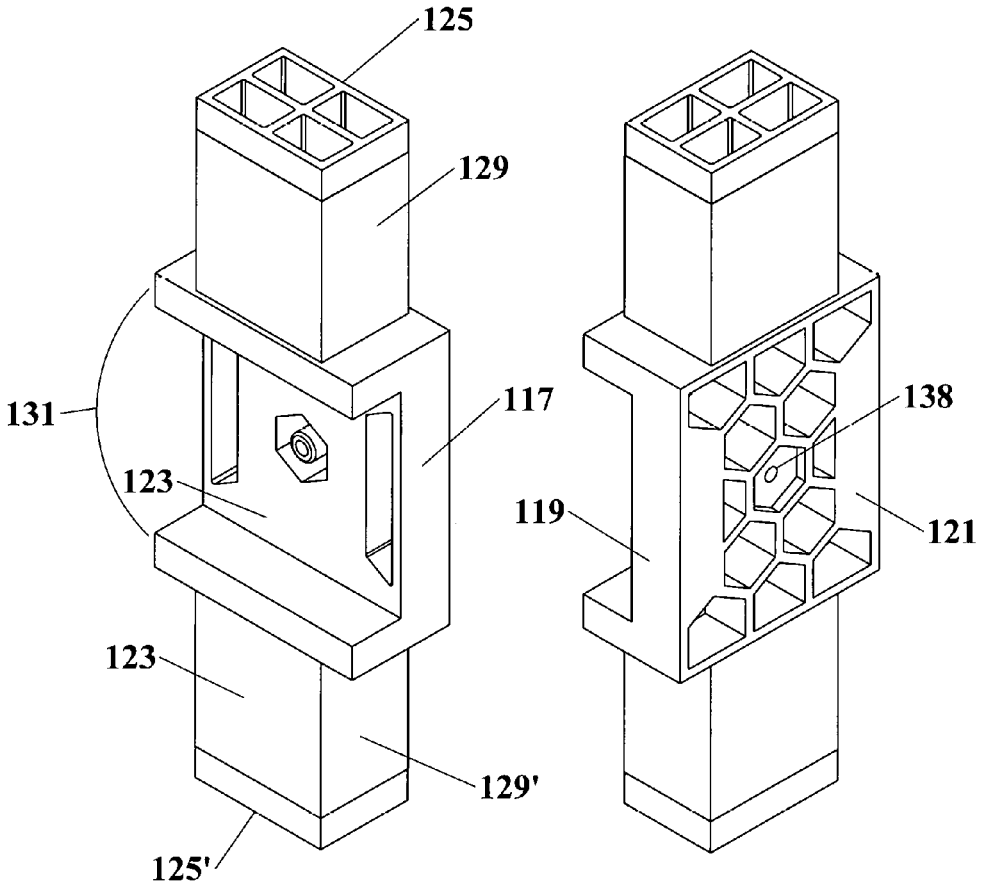

FIG. 10 is a front isomeric exploded view of a preferred embodiment of the present invention incorporating cross bars spanning all four perimeter members FIG. 11 is an isomeric view of the cross bar intersection of the present invention.

DETAILED DESCRIPTION

Figure 1:
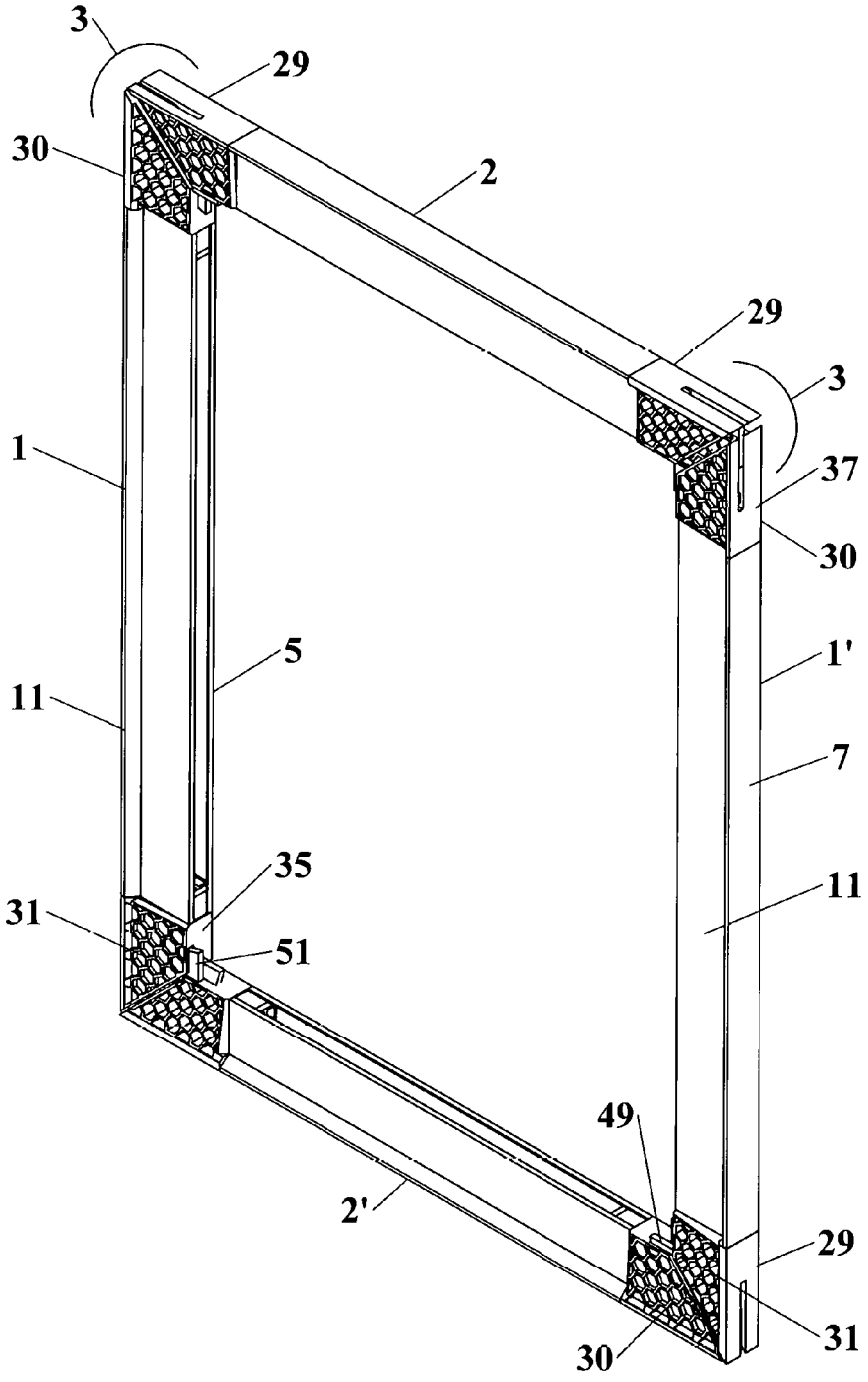
FIG. 1 is a front isomeric view of a preferred embodiment of the stretcher frame of the present invention.
Figure 2:
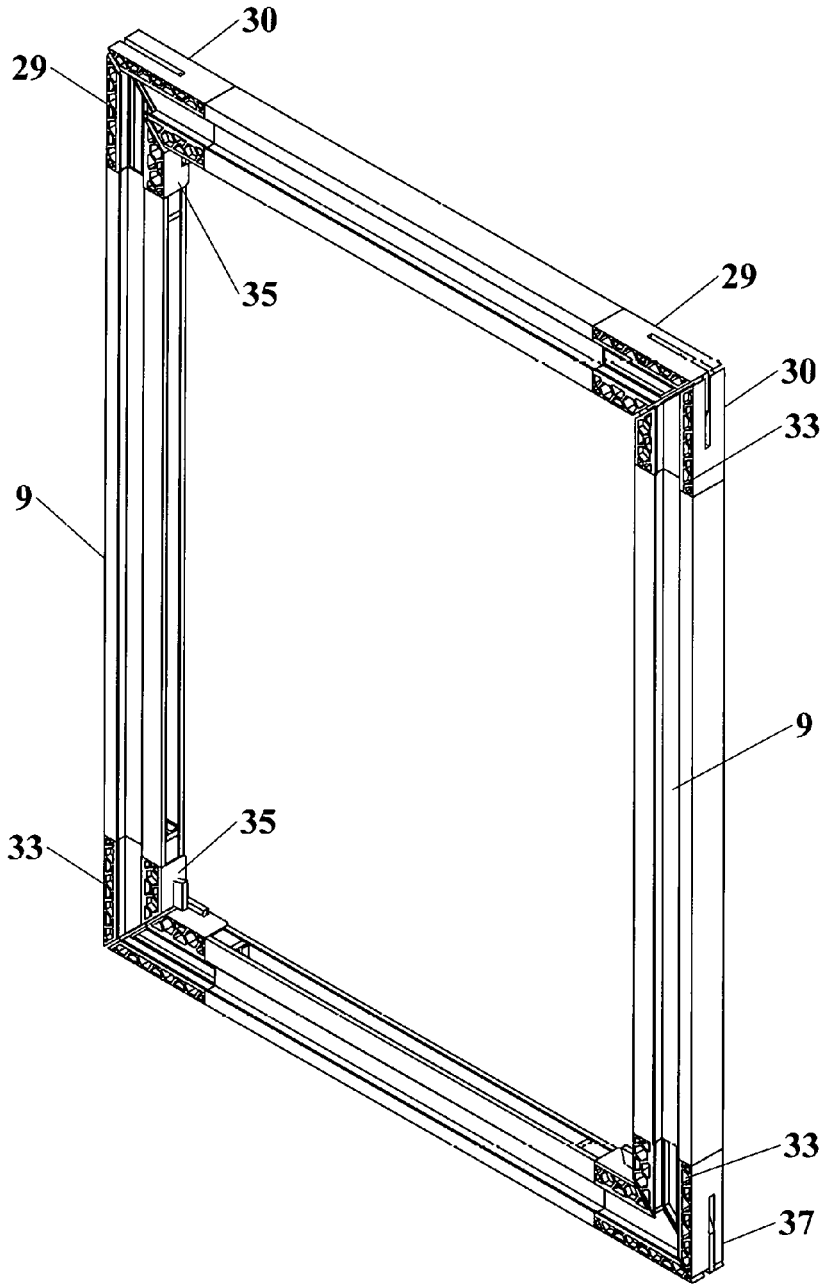
FIG. 2 is a rear isomeric view of the preferred embodiment illustrated in FIG. 1.
Figure 3:
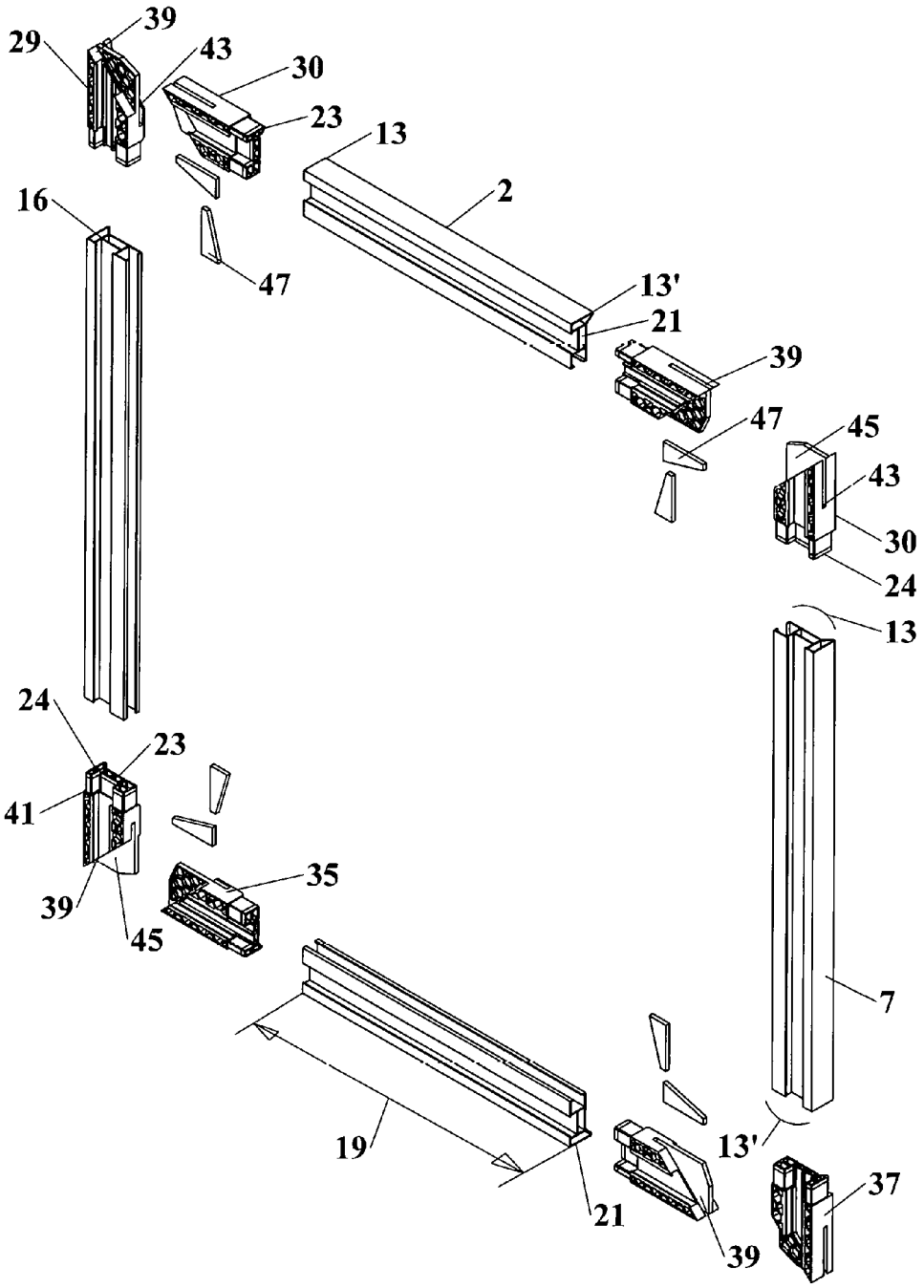
FIG. 3 is an exploded view of the preferred embodiment illustrated in FIG. 2.

FIG. 1, FIG. 2 and FIG. 3 illustrate a preferred canvas stretcher of the present invention. The stretcher is comprised of four perimeter members 1, 1', 2, 2' and four corner members 3.

FIG. 4 illustrates the perimeter member in detail. Each of the four perimeter members includes an inside edge 5, and outside edge 7, a back surface 9, a front surface 11 and two ends 13 and 13' with a longitudinal axis 17 running from one end to the other. The length of the perimeter member 19 is defined as the distance from one end of the perimeter member to the other. The term "entire length" refers to this same distance and measurement.

Each perimeter member includes a depth dimension—the distance from the front surface to the back surface—as well as a height dimension—the distance from the inside edge to the outside edge—. The perimeter members each include at least one perimeter tine receiving channel 21 running longitudinally along the entire length 19 of each perimeter member. The at least one perimeter tine receiving channel 21 is open at both ends of the perimeter member and defines a continuous and constant cross sectional size, shape and configuration along the entire length of the perimeter member which enables the below-described perimeter retaining tine 23, extending from the corner member, to matingly engage with the perimeter member, regardless of whether or not the perimeter member has been cut to a specific length or not. The preferred embodiment illustrated within the figures also includes accessory tine 24, which is especially shaped and configured to securely mate with accessory tine receiving channel 16 and accessory tine 26 which is especially shaped and configured to securely mate with the mounting block channel 27 of the perimeter member, discussed below. Although not required in order to form a secure joint between the corner member and a perimeter member, the accessory tines provide additional strength and security to this junction. The accessory tine receiving channel 16 illustrated in the figures, like the tine receiving channel 21 demonstrates a continuous size, shape and configuration along the entire length of the perimeter member which is so sized, shaped and configured so as to enable the accessory tine 26 to securely mate therewith regardless of the location of a cut along the length of the perimeter member made to provide a frame of a desired perimeter dimension. Each perimeter member also includes a mounting material retaining channel 25 having a continuous and uniform cross sectional size, shape and configuration extending along the entire length of said perimeter member. The mounting material retaining channel 25 includes a continuous opening along the back surface of each perimeter member and is especially shaped and configured to receive and contain a length of mounting material therewithin. A similar corner member material retaining channel 28 is formed adjacent to the outside surface of each corner member (and the corner sections forming same) as is especially shaped, configured and positioned to align with the mounting material channel of the perimeter members upon engagement of perimeter member with corner member. The mounting material is especially selected to be a material upon which sheet material may be affixed with, for example, staples, tacks, brads or any other suitable fastener. Suitable mounting material includes, but is not limited to, wood, cork, rubber and plastic material.

In addition to the above-mentioned design, features and configurations, each perimeter member of the present invention, also includes a cross bar mounting block channel 27 located adjacent to, and presenting a uniform and continuous opening along the inner edge thereof. The cross bar mounting block channel runs longitudinally, within the perimeter member, from one end to the other and defines a uniform cross sectional size, shape and configuration along the entire length of the perimeter member.

Due to the need for a continuous mounting material channel, continuous perimeter tine receiving channel, and continuous cross bar mounting block channel, it is highly advantageous to form the perimeter member from an extrusion process. Material suitable for such extrusion includes, for example, steel alloys, copper, aluminum and aluminum alloys. In addition, plastic materials may be utilized to form the perimeter member. For example, polyethylene (PE), polypropylene, acetal, acrylic, nylon (polyamides), polystyrene, polyvinyl chloride (PVC), acrylonitrile butadiene styrene (ABS) and polycarbonate plastics may be advantageously selected for the extrusion based formation of the perimeter member. In addition, the perimeter members may be produced via a molding process such as, for example, injection molding. Plastics, especially suitable for formation of the perimeter members via injection molding include nylon, polyethylene and polystyrene plastics. However, epoxy and phenolic plastic may also be utilized for injection molding of the perimeter member. Regardless of the specific material chosen, it is highly preferred that the perimeter member of the present invention—as well as the corner member, cross bar mounting block and cross bar intersection—be formed of a metal, metal alloy or synthetic material rather than, for example, wood—. Materials, such as metal, metal alloys and synthetic materials such as carbon fiber and plastic materials, are not subject to the relatively extreme warping as natural materials such as wood. Thus, while stretcher frames of the past have utilized, for example, wooden perimeter members, such frames have demonstrated warping over times and thus have not provided a flat surface upon which to mount a canvas painting. The present invention utilizes perimeter members, corner members and cross bars—as well as cross bar mounting blocks and cross bar intersections formed from metal and/or metal alloys as well as synthetic materials such as plastic and carbon fiber materials. Since these materials are highly resistant to warping, the stretcher frame of the present invention provides a stable flat surface upon which to mount a canvas sheet which is resistant to such warping The perimeter member of the present invention provides a frame element having a continuous and uniform cross sectional shape and configuration along the entire length thereof. Thus, these members may be cut from stock perimeter members (perimeter members formed in standardized lengths)—to any desired length—without having any effect upon the member's mechanism for: a. attachment to corner members (continuous perimeter tine receiving channel) b. mounting of cross bars (continuous cross bar mounting block channel); and c. mounting of mounting material (continuous mounting material retaining channel). Also, since the adjustment to perimeter size provided by the stretcher of the present invention is enabled via opening of the corner sections, cutting of the perimeter members also has no effect upon the stretching function of the frame.

FIGS. 4*a*, 4*b*, 5*a* and 5*b* illustrate corner members of the present invention. Each of the four corner members 3 is comprised of two complimentary corner sections 29 and 30 which are especially formed and configured, as discussed in more detail below, to be joined for form a corner member. Each corner section includes a front surface 31, a back surface 33, an inner edge 35, an outer edge 37, a 45 degree end 39 and a 90 degree end 41. The corner sections also define a height—the distance from the inner edge to the outer edge—and a depth—the distance from the front surface to the back surface—. The 45 degree ends of the corner sections are mortised so as to include at least one corner section tine receiving slot 43 and at least one corner section tine 45. The corner section tine and corner section tine receiving slot of each complimentary pair of corner sections 29 and 30 are formed, arranged and positioned so that the 45 degree ends 39 and 39' of two corner sections can be securely joined, one to the other, so as to form a corner member 3. The corner member thus formed thereby provides the 90 degree corners for the stretcher frame which is ordinarily configured so as to form a quadrilateral having a rectangular or square shape.

As mentioned above, the corner section tine receiving slot 43 is especially shaped and configured to provide mating engagement with a corner section tine 45 located on the 45 degree end of a complimentary corner section. The slot and tine position of any two complimentary corner sections, such as 29 and 30' are thus staggered to enable such mating. Beyond its joining function, each corner tine receiving slot 43 also demonstrates and provides a keyway 49 upon the joining of two such sections to form a corner member. The keyway is, in fact, a converging slot formed between a wall of the corner tine receiving slot and corner section tine after two corner sections are joined to form a corner member. Upon the above-described joining of two corner sections to form a corner member, the keyway provides an opening 49, at its widest cross sectional dimension, at a point located along the inner edge of each corner section especially suitable for entry of a corner key. Placement of a corner key 47 into this opening, and thereafter urging the key further into the corner, along the converging walls, causes the two corner sections forming the corner member to move apart. The opening of the corner member necessarily increases the perimeter dimension of the stretcher frame.

The term "PERIMETER DIMENSION" and "PERIMETER", as utilized throughout this specifications and within the claims, are equivalent terms having the same meaning and refer to the measurement in length of the perimeter of the quadrilateral stretcher frame formed when four corner members and four perimeter members are joined to form the frame as measured along the outside/outer edges/surfaces of the perimeter and corner members. For example, a stretcher frame, in accordance with the present dimension, may be assembled from four perimeter members each having a length of 16 inches. They may be joined by corner members formed of corner sections each having outside edges four inches long.

In that instance. After assembly, the perimeter of such an assembled frame would be 24 inches×4 or 96 inches. Opening the corner members by inserting corner keys into one or more of the keyways would increase this perimeter dimension by creating a space, having a length, between the two corner sections forming the corner member. Opening this space, and thus increasing the perimeter of the frame, necessarily applies tension upon a canvas mounted upon the frame when such canvas is affixed to the mounting material as described above.

Each of the 90 degree ends 41 of the corner sections includes at least one perimeter retaining tine 23 extending therefrom. However, the embodiments illustrated within the figures also include accessory tine 24 which is especially shaped and configured to securely engage accessory tine receiving channel 16 and an additional accessory tine 26 which is especially shaped and configured to securely mate within the cross bar mounting channel 27 formed also formed within the perimeter member. Although accessory tines 24 and 26 are not required for secure engagement of the perimeter member the a corner member, they do act to further stabilize and secure the joint formed between these members during and after frame assembly.

The perimeter retaining tine is especially shaped and configured to enable mating engagement within the perimeter tine receiving channel 21 described above. Engagement of the perimeter retaining tine by the perimeter tine receiving channel enables the 90 degree end of the corner sections to be securely affixed to a perimeter member—and provides all the necessary affixation required in embodiments of the present invention that utilize only one such tine—. The height and depth of the corner sections and perimeter sections are selected to be equal so that, upon affixation of the corner sections to the perimeter sections, the outside and inside edge of the perimeter sections will be aligned with and continuous with the outer and inner edges of the corner sections.

It is highly advantageous to form the above-described corner sections by means of a molding process. Although it is possible to form such corner sections by shaping wood material via the usual tooling or machining metal or plastic materials to form same, injection molding provides a highly accurate and cost effective means of such production. Suitable plastic material advantageously utilized in the injection molding of the corner section includes nylon, polyethylene, polystyrene, epoxy and phenolic plastics. Regardless of the specific material chosen, it is highly preferred that the corner member and corner sections forming same—as well as the perimeter member, cross bar, cross bar mounting block and cross bar intersection—be formed of a metal, metal alloy or synthetic material rather than, for example, wood—. Materials, such as metal, metal alloys as well as synthetic materials, such as carbon fiber and plastic materials, are not subject to the relatively extreme warping as natural materials such as wood. Thus, while stretcher frames of the past have utilized, for example, wooden perimeter members, such frames have demonstrated warping over times and thus have not provided a flat surface upon which to mount a canvas painting. The present invention utilizes components formed from metal and/or metal alloys as well as synthetic materials such as plastic and carbon fiber materials so as to avoid such warping. Since these materials are highly resistant to warping, the stretcher frame of the present invention provides a stable flat surface upon which to mount a canvas sheet which is resistant to such warping The aforementioned elements are advantageously joined, as described, to form a quadrilateral frame demonstrating a square or rectangular configuration. The desired perimeter dimension and frame shape is selected in accordance with the dimensions of a canvas to be mounted upon the frame in the usual manner. The desired dimension of the frame is accomplished by cutting perimeter members to a length, which, when combined with the corner members, will yield a desired perimeter.

Because the perimeter retaining tine receiving channel, formed within the perimeter member, is continuous along the entire length of the perimeter member, and, because adjustment to frame tension is provided by means of adjusting the distance between corner sections, the perimeter members may be cut to any desired length without effecting the corner tine receiving channel and without effecting the tensioning function of the stretcher. To put it simply, the continuous perimeter tine receiving channel remains available for mating engagement with a corner tine both before and after the perimeter member is cut to a desired length and the cutting of a perimeter member has no effect on the tensioning adjustment device of the frame.

Certain preferred embodiments of the present invention include a cross bar utilized to increase the rigidity, strength and adjustability of the stretcher. FIGS. 6 and 7 illustrate such an embodiment. These preferred embodiments include at least two cross bar mounting blocks 53 and at least one cross bar 55. An embodiment of the cross bar mounting block of the present invention is illustrated in FIGS. 8*a* and 8*b*. The cross bar mounting block is comprised a perimeter engagement section 57 and an intermediate connector section 59. The cross bar mounting block, as discussed in more detail, below, is advantageously formed of a synthetic material resistant to warping such as, for example, a metal, metal alloy or plastic Plastics, especially suitable for formation of the cross bar mounting block via, for example, injection molding, include nylon, polyethylene and polystyrene plastics. However, epoxy and phenolic plastic may also be utilized for injection molding of the cross bar mounting block.

The perimeter engagement section of the mounting block includes a distal end 61, a proximal end 63, a back surface 65, a front surface 67, a top surface 69 and a bottom surface 71. The distal end 61 of the perimeter engagement section is especially shaped and configured to mate with and mount slideably within the cross bar mounting block channel. As mentioned above, the cross bar mounting block channel 27 is located adjacent to, and presents a continuous opening along the inner edge of each perimeter member—running longitudinally, along the entire length of each perimeter member—. When the distal end of the perimeter engagement section of the cross bar mounting block is positioned within the mounting block channel, the continuous opening thereof enables the block to slide to any desired position, from one end of the perimeter member to the opposite end. The sliding of the block within the channel enables quick, convenient positioning of the cross bar mounting block (as well as a cross bar mounted thereto, at virtually any position along the inside edge of the perimeter member. The stretcher frame of the present invention enables such quick an simple adjustment—without the need to further prepare, in any way, a mounting site for the mounting block—. This is true even after, for example, the cutting of a perimeter member to form a stretcher frame of a desired perimeter dimension.

The proximal surface of the perimeter engagement section advantageously includes a tine engagement slot 73 which is especially shaped and configured so as to enable mating engagement with a tine 75, extending from and, in preferred embodiments, forming the distal portion of the intermediate connector section. The engagement of the proximally located tine engagement slot of the engagement section by the distal portion of the intermediate section effectively fastens the two sections together to form the cross bar mounting block. The perimeter engagement section may also advantageously include one or more set screw bores 77 running from an opening located at the distal end of the engagement section, completely through the engagement section to an opening prepared at the proximal end of the engagement section. The one or more set screw bores are especially configured and prepared so as to enable a set screw to be threaded through said bore via rotation of the screw and thereafter, upon further rotation, to bias against an inner wall of the cross bar block channel so as to fix the position of the block therewithin once a cross bar is mounted between two cross bar mounting blocks—so as to prevent any further lateral movement of the mounting block along the cross bar mounting block channel.

The intermediate connector section of the cross bar mounting block includes a proximal end 79, a distal end 81, a front surface 83, a back surface 85, a top surface 87 and a bottom surface 89. As mentioned above, the distal end of the intermediate connector includes at least one tine. In preferred embodiment, the distal portion of the intermediate connector section forms an intermediate tine 75 especially shaped and configured to matingly engage with the tine engagement slot 73 formed within the perimeter engagement section. Such mating engagement allows these two sections to from the complete cross bar mounting block. Located adjacent to the intermediate section tine, a mounting block keyway 91 is prepared within the intermediate section. The keyway, as described and illustrated in more detail, below, is configured and shaped so as to form a slot with an opening located on the top, bottom, and distal surface. Upon affixation of the intermediate connector section with the perimeter engagement section, the opening of the slot on the distal end of the intermediate connector section lies directly against and adjacent to the proximal surface of the perimeter engagement section. A converging wall configuration of the slot forms a keyway upon the joining of the aforementioned mounting block sections. An opening to the keyway 91 located at the top surface 87 remains after the joining of the intermediate connector section and perimeter engagement section. This opening provides access to the keyway after the intermediate connector and perimeter engagement section are so joined. This keyway is especially shaped and configured for the insertion of a cross bar mounting block key 93. Insertion of the key within the keyway forces the two sections of the mounting block—the perimeter engagement section and the intermediate connector section—to separate. The separation of these two sections, in turn, provides increase distance and tension—adjustability—between two perimeter members upon which cross bar mounts and a cross bar are mounted. The proximal end of the intermediate connector section of the cross bar mounting block includes at least one cross bar engagement tine extending therefrom. In preferred embodiments of the present invention, a portion of the intermediate engagement section, adjacent to the proximal end thereof, is shaped and configured so as to form the cross bar engagement tine 95 The cross bar engagement tine is especially shaped and configured so as to enable the cross bar mounting block to mate and securely engage a tine engagement channel 97 located within, and along the entire length of the cross bar, as described in greater detail, below.

The cross bar 96 of the present invention, an example of which is illustrated in FIG. 9, includes a front surface 99, a back surface 101, a top surface 103, a bottom surface 105 and two ends 107/107'. The cross bar includes a longitudinal axis 110 running from one end of the bar to the other. The cross bar also defines a length 111 which is measured from one end of the bar to the other. The cross bar includes at least one tine engagement channel 97, running the entire length thereof which said channel is open at either end of the cross bar. The cross sectional shape, configuration and size of the cross bar tine engagement channel are continuous and especially formed to enable mating engagement of the receiving channel with the cross bar engagement tine 95 extending from the proximal end of the intermediate connector. The cross bar, as discussed in more detail, above and below, is advantageously formed of a metal, metal alloy or synthetic material such as a plastic or carbon fiber material. Such materials are highly resistant to warping. It is also highly advantageous to form the cross bar by means of an extrusion process since the cross sectional size, shape and configuration of the cross bar is continuous and uniform through the entire length thereof. Material suitable for such extrusion includes, for example, steel alloys, copper and aluminum. In addition, plastic materials such as polyethylene (PE), polypropylene, acetal, acrylic, nylon (polyamides), polystyrene, polyvinyl chloride (PVC), acrylonitrile butadiene styrene (ABS) and polycarbonate plastics may be advantageously selected for the extrusion based formation of the cross bar of the present invention. In addition, the cross bar may be produced via a molding process such as, for example, injection molding. Plastics, especially suitable for formation of the perimeter members via injection molding include nylon, polyethylene and polystyrene plastics. However, epoxy and phenolic plastic may also be utilized for injection molding of the cross bar.

In certain preferred embodiments of the present invention, two cross bar mounting blocks, as described above, may be used to mount a cross bar between two pairs of opposite perimeter members (such as 1/1' or 2/2') forming the stretcher of the present invention. As discussed above, the stretcher of the present invention facilitates the cutting of the perimeter members forming, along with four corner members, the stretcher, so as to attain a desired custom perimeter dimension. Upon cutting such perimeter members, two of the above-described cross bars mounting blocks may be mounted within mounting block receiving channels located adjacent to and open along the inner edge of opposing perimeter members. The mounting block receiving channel of the perimeter member is a continuous channel. Thus, regardless of how much perimeter bar is cut to attain a desired frame size, the cross bar can be quickly and easily positioned without having to prepare new mount since the cross bar mounting block can be slid to any desired position along the continuous mounting block channel. Ordinarily, two mounting blocks will be positioned upon opposite perimeter members at the same point along the length of such members so that the longitudinal axis of the cross bar will be in a perpendicular relation with the longitudinal axis of the perimeter members from which they extend via the mounting blocks.

Likewise, cutting the perimeter members to a achieve a desired perimeter size can change the length of cross bar required to span the distance from one cross bar mount to an opposite mount. Since the tine engagement channel formed within the cross bar of the present invention is uniform and continuous throughout the entire length of this element, the cross bar can be cut in accordance with changes in perimeter dimension without need for mortising a new tine receiving channel within the bar.

For example, one may wish to cut perimeter members of the present invention to form a frame having a given perimeter dimension. After the perimeter members are cut, they are joined by use of corner members without need for preparing new perimeter tine receiving channels. Since the perimeter tine receiving channels are continuous along the entire length of the perimeter members, there is no need to mortise or otherwise prepare a new tine receiving channel after cutting the perimeter member. Thereafter, if, for example, it is desired to incorporate one cross bar within the stretcher frame, the perimeter engagement section of two cross bar mounts are simply inserted into, and slid along the cross bar mounting block channel located alongside the inside edge of the perimeter member until they are located at, for example, the midpoint of the length of two opposing perimeter members. Since the mounting block channel runs the entire length of the perimeter member, there is no need to prepare, mortise or otherwise form a new mounting joint for the cross bar mount. The term "opposing perimeter members" and "opposite perimeter members", as used throughout this specification and within the claims refers to two perimeter sections of a frame formed from four such sections and four corner members to form a quadrilateral frame. "Opposing perimeter members" and "opposite perimeter members" refer to any two perimeter members which are not adjacent to one another and are not connector to each other via a corner member. Opposing perimeter members and opposite perimeter members refer to those members, having longitudinal axis parallel to one another.

A measurement of the distance between the proximal ends of the intermediate section of the mounting blocks may be utilized to calculate the length of the cross bar necessary to span the distance between two mounting blocks. This distance is calculated so as to provide that the cross bar will be of the proper length to enable full insertion of the cross bar engagement tine within the engagement channel of the cross bar. Since the tine engagement channel of the cross bar is continuous, along the entire length of the cross bar, the cross bar may be cut without having to mortise a new engagement slot therein. Thus, the stretcher frame and the method of producing a stretcher frame of the present invention enables custom cutting of perimeter members and cross members to be accomplished quickly and easily without need for spending substantial time and effort in creating custom mortising within the custom cut members of the frame.

The cross bar mounting blocks are configured and adapted so that a cross bar so mounted between two opposing mounting blocks is positioned so that the front and back surfaces of the cross bar is in the same horizontal place as the front and back surfaces of the perimeter members and corner members. Such an arrangement is beneficial in providing a canvas, mounted over the front surfaces of the perimeter members and cross bar, lies against an even surface.

In certain preferred embodiments of the present invention, it may be desired to utilize cross bars to connect two pairs of opposing perimeter members. Such an embodiment is illustrated in FIG. 9 FIG. 1*n* such instances, two sets of cross bars 112/112' and 114/114' are utilized to join two opposite sets of perimeter members. In FIG. 9, a first pair of opposite perimeter members are shown as 1 and 1' and a second pair of opposite perimeter members are shown as 2 and 2'. In other words, in certain embodiments, the frame formed by the canvas stretcher may include cross bars extending between all four perimeter members. In such instances, the stretcher of the present invention provides a cross bar intersection 118 which enables the back and front surface of two pairs of intersecting cross bars to lie within the same horizontal plane with one another while also further stabilizing the cross bars. This is, of course, especially important in regard to the front surface of the cross bar as it is upon and over the front surface of the cross bar, as well as the rest of the components of the stretcher frame of the present invention, that a canvas is mounted and stretched. Contact of uneven surfaces by the canvas could cause damage thereto, especially during tightening of the frame. The aforementioned configuration wherein two pairs of perimeter members are each joined by a pair of cross bars forms what can best be described as a 4-way intersection.

As shown in detail in FIG. 10, the cross bar intersection 118 of the present invention includes a lower surface 117, an upper surface 119, a back surface 121, a front surface 123 and two ends 125, 125'. The intersection can be described as having a longitudinal axis 127 running from one end of the intersection to the other, all being parallel to the back surface, a front surface, lower surface and upper surface. The intersection includes two cross bar insertion sections 129, 129' located adjacent to opposite ends of the intersection and a central bypass section 131 located between the cross bar insertion sections.

The cross bar insertion sections are especially shaped and configured so as to enable insertion of same within the tine engagement channel 97 of a cross bar. Since the insertion sections are located at both ends of the cross bar intersection section, the intersection serves to join two lengths of cross bar extending from opposite perimeter members (such as 1 and 1'), as to form a structurally complete support spanning the distance between such opposite perimeter members. The insertion sections are advantageously shaped and configured so as to align the tine engagement channels of two cross bars so that the front and back surfaces of two such cross bars connected thereby lie within the same horizontal plane.

As mentioned above, the cross bar mounting blocks of the present invention are shaped, positioned and configured so that the front and back surfaces of the cross bars mounted therein lie in the same plane and the front and back surfaces of the perimeter members as well as the corner members. Thus, the intersection of the present invention compliments maintenance of the aforementioned uniform horizontal plane which is, as mentioned above, beneficial to the canvas material mounted upon the stretcher frame.

As mentioned above, when embodiments of the present invention utilize cross bars running between two pairs of opposing perimeter members so as to necessitate such cross bars running across one another, (generally, at a 90 degree angle) provision for the elimination of overlap of such cross bars—at the point of intersection—is advantageous so as to maximize the stability provided thereby and also to provide an even surface against which a canvas is positioned. In order to eliminate the aforementioned overlap, the intersection component of the present invention advantageously incorporates bypass section 131 which is offset in relation to the horizontal planes defined by the back or front surface of the cross bars. In addition, the cross bar bypass section demonstrate a thickness—measured as the distance between the front and back surfaces of the bypass section—which is less, and most advantageously, approximately ½ the thickness of the cross bar.

By utilizing a bypass section having ½ the thickness of the cross bar and offset so as to lie in the same horizontal plane as either the front surface or back surface of the cross bars joined by said intersection, the bypass sections of two such cross bar intersections may be joined in a 90 degrees relationship to form a 4 way intersection, as shown in FIGS. 9 and 11, enabling the front and back surfaces of two sets of cross bars joined thereby to lie within the same horizontal plane. Put simply, the offset position and reduced thickness of the bypass section enables assembly of two cross bar intersections at a 90 degree relationship so as to place the front surfaces and back surfaces of all four engagement sections joined via the intersection to lie in the same horizontal plane.

Thus, cross bars inserted therein will likewise be aligned so as to be horizontally aligned in regard to the same horizontal plane.

Holes 38, which may advantageously be threaded, are utilized to enable a bolt or screw or bolt to fasten two of the above-described cross bar intersections together in the aforementioned 90 degree relation so as to form a stable 4 way cross bar intersection. In certain preferred embodiments of the present invention utilizing the above-described 4 way intersection, it may be highly advantageous to utilize an intersection reinforcement overlay 139 to further support and increase the rigidity of such intersections. The overlay is aligned with and placed over two cross bar intersections forming the above-described 4 way intersection. Such intersection reinforcement overlays also may advantageously include bores prepared therewithin 141 so as to enable screws, bolts or other fasteners to be utilized to firmly attach the intersection reinforcement overlay to the intersections lying thereunder.

The terms and expressions which have been employed in the foregoing specification and within the abstract are used as terms of description and not limitation and there is no intention, in use of such terms and expressions, of excluding equivalents of the features shown and described or portions thereof, it being recognized that the scope of the invention is define and limited by the following claims.

I claim:

1. A method for producing a custom sized canvas stretcher frame comprising:

selecting four perimeter members, each such perimeter member including an inside edge, and outside edge, a front surface, a back surface, two ends, a longitudinal axis and a total length as measured from one end of the perimeter member to an opposite end, the perimeter member including at least one corner tine receiving channel running longitudinally along the total length of the perimeter member, the at least one corner tine receiving channel demonstrating a uniform and continuous cross sectional size, shape and configuration especially designed and adapted to matingly engage a perimeter retaining tine, each perimeter member further including a mounting material retaining channel extending along and demonstrating a continuous opening upon the back surface of the perimeter member and along the total length thereof, said material retaining channel demonstrating a continuous and uniform cross sectional size, shape and configuration especially designed and adapted to receive and securely contain a length of mounting material therein and wherein each perimeter member additionally including a cross bar mounting block channel running longitudinally along the total length of the perimeter member adjacent to, and presenting a continuous opening along the inside edge of the total length of each perimeter member and demonstrating a uniform and continuous cross sectional size, shape and configuration, the cross bar mounting channel being especially designed and adapted for the mounting and retention of a cross bar mounting block;

determining a required length of each of the four perimeter members necessary in order to provide a stretcher frame of a desired perimeter measurement;

cutting the perimeter members as required in order to attain four perimeter members of the required length thereof;

selecting four corner members, each being comprised of two corner sections and an adjustment key, each corner section including a front surface, a back surface, an inner edge, an outer edge, a 45 degree end and a 90 degree end, wherein, each of the 45 degree ends of the corner sections is mortised to include at least one corner section tine receiving slot and at least one corner section tine which are so formed, arranged and positioned so that the 45 degree ends of the two corner sections can be securely joined together thereby to form a corner member while also providing, adjacent to the corner section tine receiving slot, a keyway especially shaped and configured so as to enable insertion therein of an adjustment key which, when inserted therewithin, enables controlled opening of a space between the two corner sections; and, extending from each of the 90 degree ends of the corner sections, at least one corner member tine especially shaped and configured to allow mating engagement with the corner tine receiving channel of a perimeter member thereby enabling the 90 degree end of the corner sections to be securely affixed to a perimeter member;

joining the four perimeter members of required length with four corner members by inserting the corner member tines extending from the 90 degree ends of each of the four corner members into the corner tine receiving channel of the perimeter members so as to form a stretcher frame of a desired perimeter measurement without having to mortise or perform any further joinery upon said perimeter members to join same.

2. The method of claim 1 wherein said frame further comprises at least two cross bar mounting blocks and at least one cross bar; wherein the at least two cross bar mounting blocks are comprised of a perimeter engagement section and an intermediate engagement section;

the perimeter engagement section of the cross bar mounting block including a distal end, a proximal end, a back surface, a front surface, a top surface and a bottom surface, the distal end of the perimeter engagement section being especially shaped and configured to mate with, engage and slideably mount within the cross bar mounting block channel, the proximal surface of the perimeter engagement section including an intermediate tine engagement slot especially shaped and configured so as to enable mating engagement with an intermediate tine extending from a distal portion of the intermediate connector section;

the intermediate connector section including a proximal end, a distal end, a front surface, a back surface, a top surface and a bottom surface, the distal portion of the intermediate connector section forming an intermediate tine especially shaped and configured to matingly engage with the tine engagement slot formed within the perimeter engagement section, the proximal end of the intermediate connector section of the cross bar mounting block including at least one cross bar engagement tine extending therefrom especially sized, shaped and configured so as matingly engage a tine engagement channel located within, and along the entire length of the cross bar;

the cross bar including a front surface a back surface, a top surface, a bottom surface and two ends, the cross bar including a longitudinal axis running from one end of the bar to the other, the cross bar also defining an entire length measured from one end of the cross bar to the other and including at one tine engagement channel running the entire length thereof and open at both ends of the cross bar, the tine engagement channel demonstrating a uniform and continuous cross sectional size, shape and configuration especially designed and adapted to enable mating engagement with the cross bar engagement tine extending from the proximal end of the intermediate connector; wherein said method further comprises positioning the at least two cross bar mounting blocks within the cross block mounting block channels of two opposing perimeter members so that the distal end of the perimeter engagement sections thereof engages and fits within the mounting block channel of the perimeter member and so that the cross bar mounting blocks are positioned opposite one another upon along each of two opposing perimeter members;

cutting the at least one cross bar to a length such that when the four perimeter members are affixed to one another by means of the four corner members, the length of the cross bar will enable the cross bar to span the distance between the two cross bar mounting blocks;

inserting the cross bar engagement tine formed at the proximal end of the intermediate connector of the cross bar mounting blocks within the cross bar tine engagement channel at the two ends of the cross bar so as to enable the mounting blocks to fully mate with and fully engage the cross bar.

3. The method of claim 1 wherein the four perimeter members and four corner members are all formed from a metal material.

4. The method of claim 3 wherein the metal material is selected from the group consisting of steel alloys, copper, aluminum and aluminum alloys.

5. The method of claim 1 wherein the four perimeter members and four corner members are formed from a plastic material.

6. The method of claim 5 wherein the plastic material is selected from the group consisting of, polyethylene (PE), polypropylene, acetal, acrylic, nylon (polyamides), polystyrene, polyvinyl chloride (PVC), acrylonitrile butadiene styrene (ABS) and polycarbonate, nylon, polyethylene and polystyrene plastic.

7. The method of claim 2 wherein the four perimeter members, four corner members and at least one cross bar are formed from a plastic material.

8. The method of claim 7 wherein the plastic material is selected from the group consisting of, polyethylene (PE), polypropylene, acetal, acrylic, nylon (polyamides), polystyrene, polyvinyl chloride (PVC), acrylonitrile butadiene styrene (ABS) and polycarbonate, nylon, polyethylene and polystyrene plastic.

9. The method of claim 2 wherein the four perimeter members, four corner members and at least one cross bar are formed from a metal material.

10. The method of claim 9 wherein the metal material is selected from the group consisting of steel alloys, copper, aluminum and aluminum alloys.

11. The method of claim 2 wherein the four perimeter members, four corner members and at least one cross bar are formed from a carbon fiber material.

12. A stretcher frame assembly kit for producing a custom sized canvas stretcher frame comprising:

four perimeter members, each such perimeter member including an inside edge, and outside edge, a front surface, a back surface, two ends, a longitudinal axis and a total length as measured from one end of the perimeter member to an opposite end, the perimeter member including at least one corner tine receiving channel running longitudinally along the total length of the perimeter member, the at least one corner tine receiving channel demonstrating a uniform and continuous cross sectional size, shape and configuration especially designed and adapted to matingly engage a perimeter retaining tine, each perimeter member further including a mounting material retaining channel extending along and demonstrating a continuous opening upon the back surface of the perimeter member and along the total length thereof, said material retaining channel demonstrating a continuous and uniform cross sectional size, shape and configuration especially designed and adapted to receive and securely contain a length of mounting material therein and wherein each perimeter member additionally including a cross bar mounting block channel running longitudinally along the total length of the perimeter member adjacent to, and presenting a continuous opening along the inside edge of the total length of each perimeter member and demonstrating a uniform and continuous cross sectional size, shape and configuration, the cross bar mounting channel being especially designed and adapted for the mounting and retention of a cross bar mounting block;

four corner members, each being comprised of two corner sections and an adjustment key, each corner section including a front surface, a back surface, an inner edge, an outer edge, a 45 degree end and a 90 degree end, wherein, each of the 45 degree ends of the corner sections is mortised to include at least one corner section tine receiving slot and at least one corner section tine which are so formed, arranged and positioned so that the 45 degree ends of the two corner sections can be securely joined together thereby to form a corner member while also providing, adjacent to the corner section tine receiving slot, a keyway especially shaped and configured so as to enable insertion therein of an adjustment key which, when inserted therewithin, enables controlled opening of a space between the two corner sections; and, extending from each of the 90 degree ends of the corner sections, at least one corner member tine especially shaped and configured to allow mating engagement with the corner tine receiving channel of a perimeter member thereby enabling the 90 degree end of the corner sections to be securely affixed to a perimeter member wherein the four perimeter members may be cut to a desired length and thereafter joined with four corner members by inserting the corner member tines extending from the 90 degree ends of each of the four corner members into the corner tine receiving channel of the perimeter members so as to form a stretcher frame of a desired perimeter measurement without having to mortise or perform any further joinery upon said perimeter members to join same.

* * * * *